US006959164B1

(12) United States Patent
Baughman et al.

(10) Patent No.: US 6,959,164 B1
(45) Date of Patent: Oct. 25, 2005

(54) APPARATUS FOR CLEANING A PRESSURE ROLL IN A FUSING STATION

(75) Inventors: Richard C. Baughman, Geneseo, NY (US); Terry N. Morganti, Brockport, NY (US); Michael K. Baskin, Springwater, NY (US); Borden H. Mills, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 107 days.

(21) Appl. No.: 10/669,077

(22) Filed: Sep. 23, 2003

Related U.S. Application Data

(60) Provisional application No. 60/413,903, filed on Sep. 26, 2002.

(51) Int. Cl.[7] ..... G03G 15/20
(52) U.S. Cl. ..... 399/327
(58) Field of Search ..... 399/326, 327, 399/328, 400; 219/216; 15/97.1, 102, 208

(56) References Cited

U.S. PATENT DOCUMENTS

| | | | | |
|---|---|---|---|---|
| 5,512,729 A * | 4/1996 | Kusaka et al. | ..... | 219/216 |
| 6,026,272 A * | 2/2000 | Kusaka et al. | ..... | 399/327 |
| 6,243,558 B1 * | 6/2001 | Oota | ..... | 399/326 |
| 6,718,155 B2 * | 4/2004 | Kaji et al. | ..... | 399/354 |

FOREIGN PATENT DOCUMENTS

| | | | |
|---|---|---|---|
| JP | 07-219379 | * | 8/1995 |
| JP | 08-095413 | * | 4/1996 |
| JP | 2001-005325 | * | 1/2001 |
| JP | 2001-075402 | * | 3/2001 |
| JP | 2001-075403 | * | 3/2001 |

* cited by examiner

*Primary Examiner*—Robert Beatty
(74) *Attorney, Agent, or Firm*—Kevin L. Leffel

(57) ABSTRACT

The invention generally relates to the field of fusing powder toner images on receiver sheets. According to various aspects of the invention, methods and apparatus are provided of cleaning, only during standby, a pressure roller that cooperates with a fuser roller in fusing toner images. The pressure roller is cleaned with a cleaning pad mounted adjacent the pressure roller in an electrographic printer.

6 Claims, 6 Drawing Sheets

APPARATUS FOR CLEANING A PRESSURE ROLL IN A FUSING STATION

BACKGROUND

The invention generally relates to the field of fusing powder toner images on receiver sheets.

Fusers for fusing powder toner images on receiver sheets, for examples images formed by an electrographic process, typically include a fuser roller and a pressure roller. In general, the fuser roller is heated, and the pressure roller is not heated. The pressure roller is subject to contamination, for example, from toner and paper residue. Most pressure roller contamination is cleaned by subsequent prints, as they pass through the fusing nip. Some pressure roller contamination however, remains on the pressure roller after a print run is completed. Pressure roller contamination that remains on the pressure roller after a print run can cause image defects, or even jams on subsequent print runs if the contamination is sufficiently severe.

It has thus been noted that both image defects and jams occur with a higher frequency just after a machine standby period. Heating of the fuser roller typically continues during standby. In the case of an externally heated fuser, heating of the fuser roller is accomplished through rotating contact with the heater rollers and pressure roller. This rotating contact also heats the pressure roller. Contamination is more easily removed from a hot pressure roller, and tends to be removed in an uncontrolled and incidental manner leading to image defects and jams.

A primary source of pressure roller contamination is cold offsetting from the backside of a print onto the pressure roller. Offset increases as run length increases since cold offset tends to increase as temperature is decreased, and pressure rollers are typically unheated during a run. Heating the pressure roller will reduce pressure roller contamination, but is expensive and may cause side effects such as print "bricking" and excessive curl since the prints receive more heat.

Since pressure roller contamination accumulates during continuous runs, and is inadvertently removed after standby periods, the higher the ratio of run length to standby, the higher the level of pressure roller contamination. Thus, as print rate and run length increase, the probability of pressure roller contamination also increases.

SUMMARY OF THE INVENTION

Methods and apparatus are provided of cleaning a pressure roller that cooperates with a fuser roller in fusing toner images, comprising cleaning the pressure roller only during standby with a cleaning pad mounted adjacent the pressure roller in an electrographic printer.

DETAILED DESCRIPTION

Figure 1:
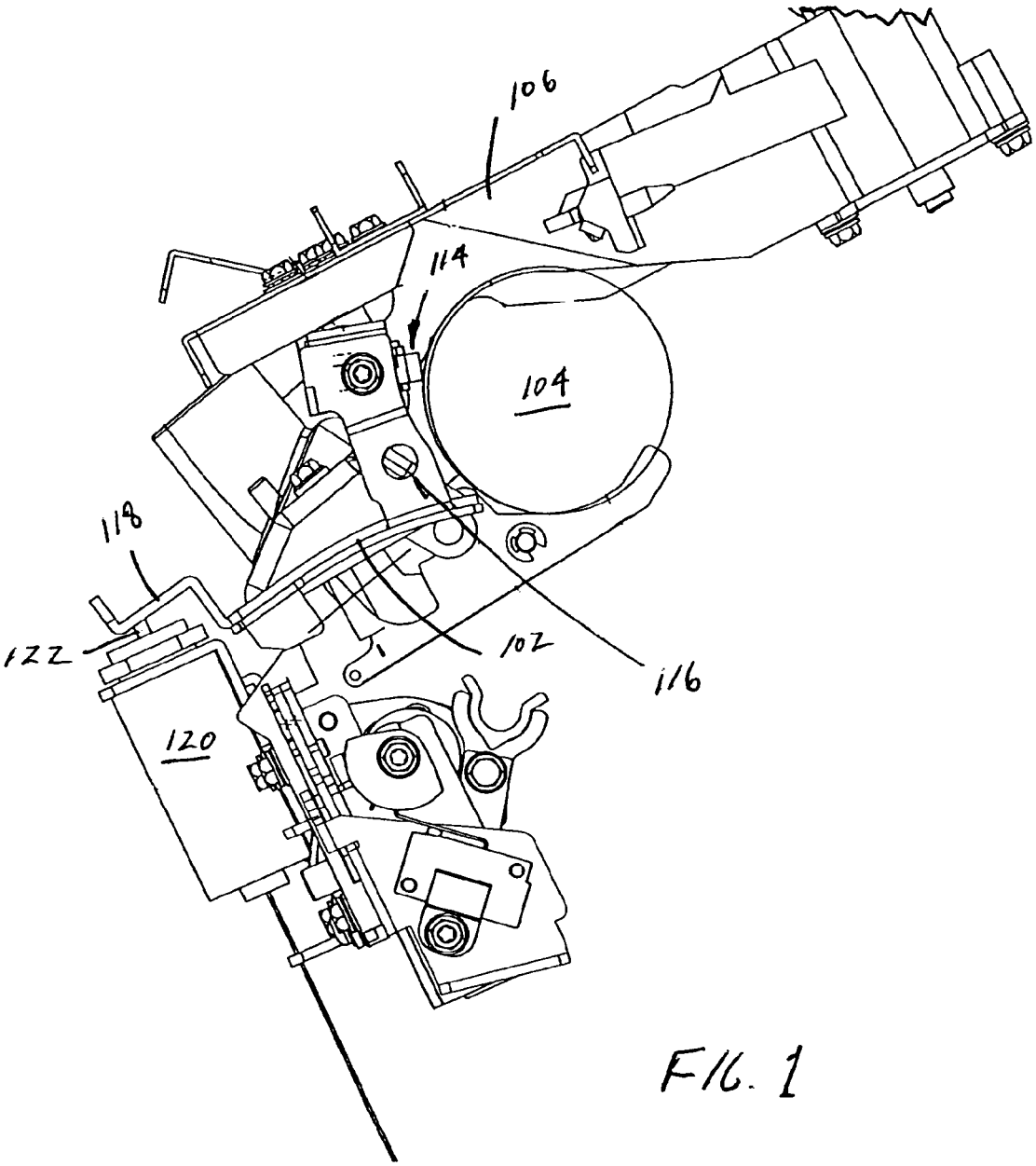
FIG. 1 presents a cross-sectional view of a pressure roller, paper entrance guide, and load arm assembly, with a cleaning pad according to an aspect of the invention.
Figure 2:
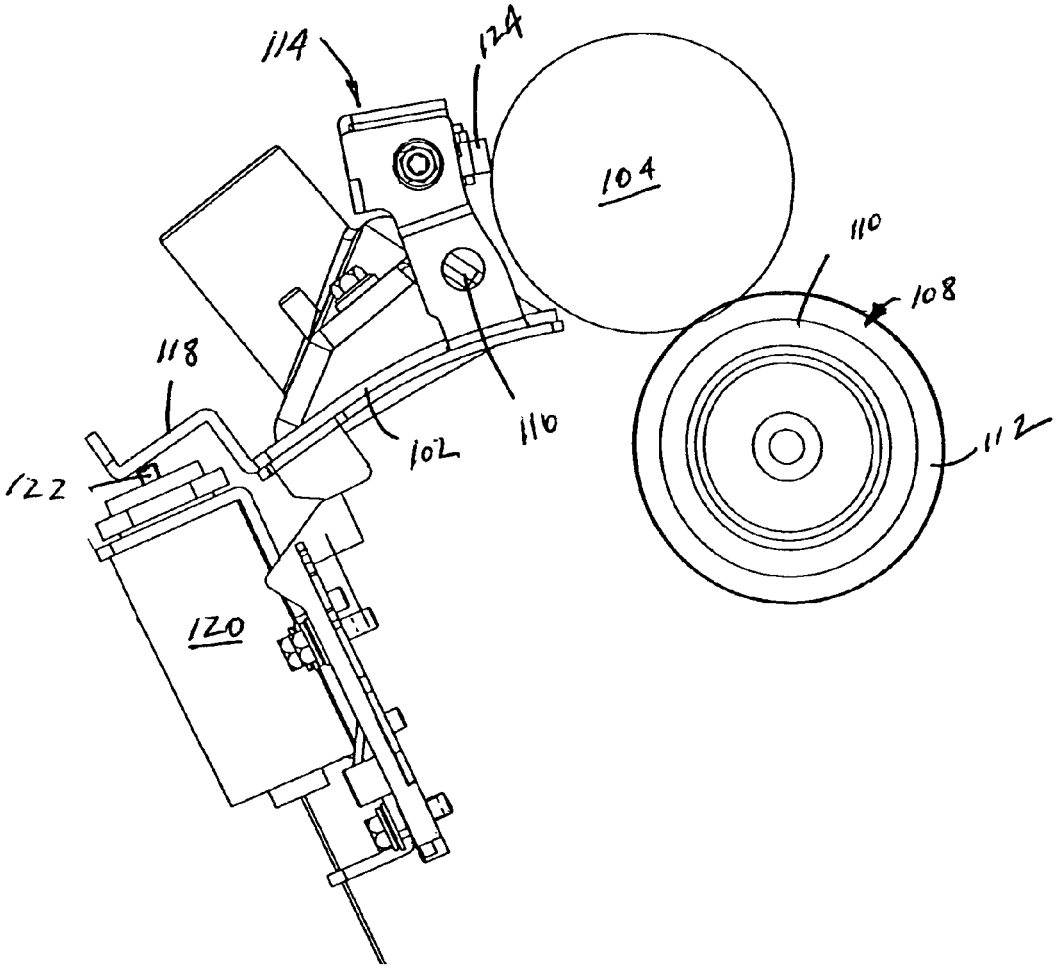
FIG. 2 presents a cross-sectional view of a fuser roller, pressure roller, and an entrance guide with a cleaning pad assembly according to an aspect of the invention, disengaged.
Figure 3:
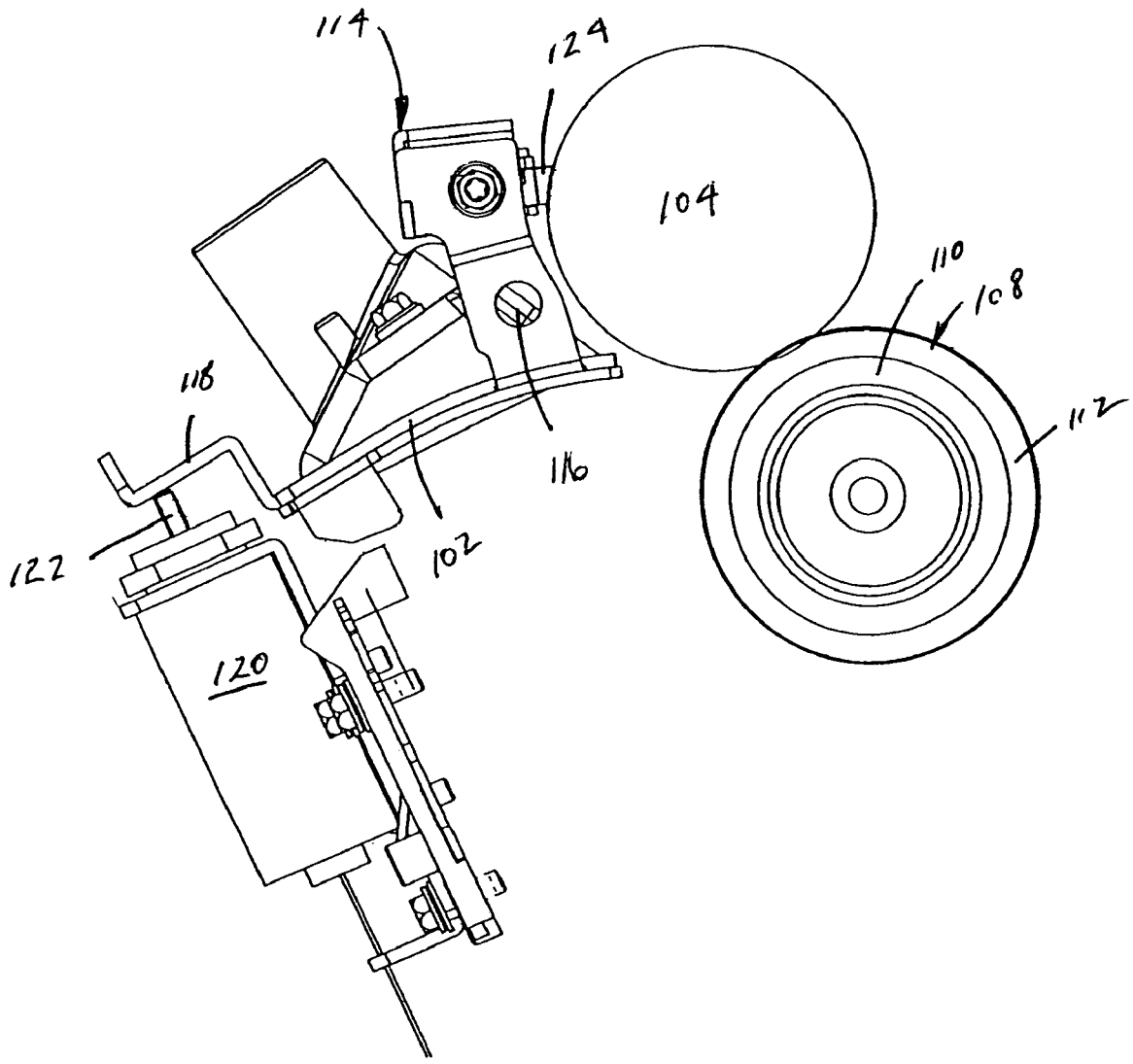
FIG. 3 presents a cross-section view of a fuser roller, pressure roller, and an entrance guide with a cleaning pad assembly according to an aspect of the invention, engaged.

Various aspects of the invention are presented in FIGS. 1–6, which are not drawn to any particular scale, and wherein like components in the numerous views are numbered alike. Referring now to FIG. 1, a cross sectional view of a portion of a fuser comprising a paper entrance guide 102, a pressure roller 104, and a pressure roller load arm 106. With reference to FIGS. 2 and 3, a load is applied to the pressure roller load arm 106 during normal operation of the fuser that forces the pressure roller 104 against a fuser roller 108 with a predetermined force, as is known in the art. The load arm 106 causes the pressure roller 104 to pivot around a pressure roller load arm pivot 116. The pressure roller 104 is formed from metal, and the fuser roller 108 is formed from a metal core 110 covered by an elastomeric blanket 112. The paper entrance guide 102 comprises a cleaning pad assembly 114 configured to clean the pressure roller 104. The paper entrance guide 102 is an existing structure presently used to guide paper into a particular location about the fuser roller 108 so that paper wrinkles and other paper defects are reduced. The cleaning pad assembly 114 could be mounted other places as well.

Referring now specifically to FIG. 2, a cross-sectional view of the fuser roller 108, pressure roller 104, and the entrance guide 102 with the cleaning pad assembly 114 disengaged is presented. According to a preferred embodiment, the entrance guide 102 is configured to pivot around the pressure roller load arm pivot 116, and the cleaning pad assembly 114 is mounted on the entrance guide 102 and pivots with the entrance guide 102 around the pressure roller load arm pivot 116. In the embodiment presented, the entrance guide 102 comprises an arm 118. A solenoid 120 is mounted in a fixed position relative to the entrance guide 102, and has a plunger 122 in contact with the arm 118. The entrance guide 102 guides sheets into a nip formed between the pressure roller 104 and the fuser roller 108.

Referring now to FIG. 3, a cross-sectional view of the fuser roller 108, pressure roller 104, and the entrance guide 102 with the cleaning pad assembly 114 engaged is presented. The cleaning pad assembly 114 preferably has a pliable pad 124 that conforms to the surface of the pressure roller 104. The structure of the cleaning pad assembly 114 will be discussed in more detail. The cleaning pad assembly 114 is engaged by actuating the solenoid 120, which extends the plunger 122 against the arm 118, thereby causing the entrance guide 102 and cleaning pad assembly 114 to rotate around the pressure roller load arm pivot 116. The solenoid generates a force adequate to clean the contamination off the pressure roller 104 in a fixed amount of time.

According to one aspect of the invention, a method of cleaning a pressure roller 104 that cooperates with a fuser roller 108 in fusing toner images is provided, comprising cleaning the pressure roller 104 only during standby with a cleaning pad 124 mounted adjacent the pressure roller 104 in an electrographic printer. As used herein, "standby" means a period of time wherein the electrographic printer is able to print images, but is not printing images, and the fuser roller 108 and pressure roller 104 are engaged with each other and rotating, and the fuser roller 108 is heated in order to maintain it at an elevated temperature suitable for fusing toner images. The load on the pressure roller load arm 106 may be decreased during standby in order to extend life of the fuser roller 108. Thus the pressure roller may be cleaned while the fuser roller 108 is heated and rotating and the pressure roller 104 is rotating, without passing sheets through the pressure roller 104 and the fuser roller 108. According to a preferred embodiment, the cleaning is initiated and stopped during this period of time. The cleaning period may be subsequent to an initial period during standby wherein the fuser roller 108 is heated in order to heat the pressure roller 104 so the pressure roller 104 is hotter than at the beginning of the initial period. Alternatively, the cleaning period may be prior to the initial period.

Figure 4:
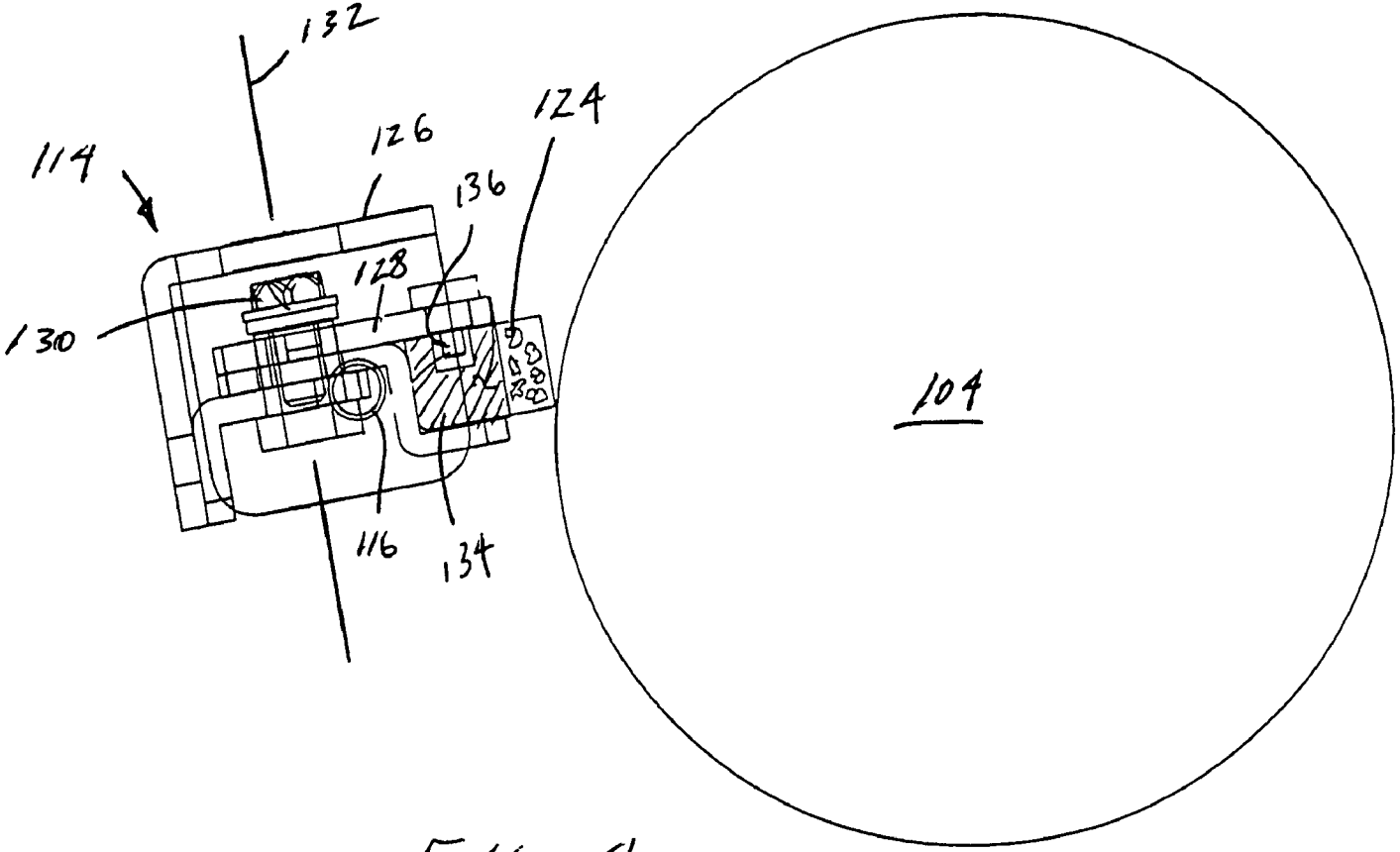
FIG. 4 presents an enlarged cross-sectional view of a pressure roller and cleaning pad, according to an aspect of the invention.

Referring now to FIG. 4, an enlarged cross sectional view of the cleaning pad assembly 114 and pressure roller 104 is presented. The cleaning pad assembly 114 comprises support 126. A pad holder 128 is mounted to the support 126 with a gimble pin 130 so that it can rotate about the gimble pin 130. In this example, the gimble pin 130 comprises a screw and sleeve. The gimble pin 130 acts as a pivot and allows the pad holder 128 to rotate about an axis 132 defined by the gimble pin 130, thereby allowing the cleaning pad 124 to align itself longitudinally with the surface of the pressure roller 104. The gimbaling eliminates the need for tight tolerances and distributes the load evenly across the cleaning pad 124. The cleaning pad 124 is adhesively bonded to a slotted bar 134, and the pad holder 128 comprises mounting pins 136 that extend into the slotted bar 134, thereby registering the slotted bar 134 with the pad holder 128.

Figure 5:
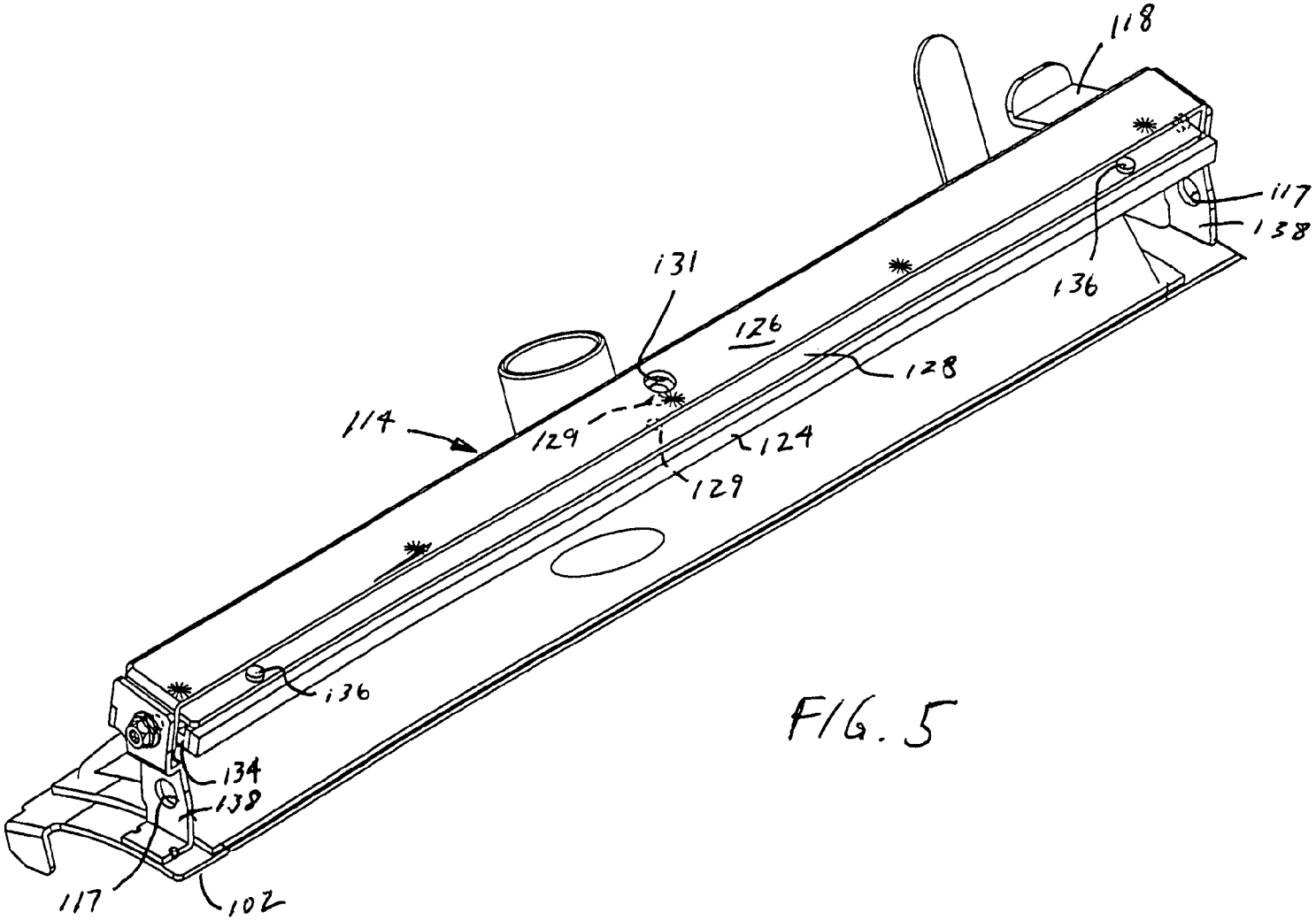
FIG. 5 presents a perspective a paper entry guide having a cleaning pad, according to an aspect of the invention.

Referring now to FIG. 5, a perspective view of the cleaning pad assembly 114 and paper entrance guide 102 is presented. The cleaning pad assembly 114 comprises a pair of brackets 138 that attach the support 126 to the paper entrance guide 102, preferably rigidly. Each bracket 138 comprises a pivot hole 117 that receives a corresponding pivot 116. The support 126 comprises an access hole 131 so the gimble pin 130 may be reached with a tool for detachment. The pad holder 128 comprises one or more gimble pin holes 129 (shown in phantom) that receive the gimble pin 130.

Figure 6:
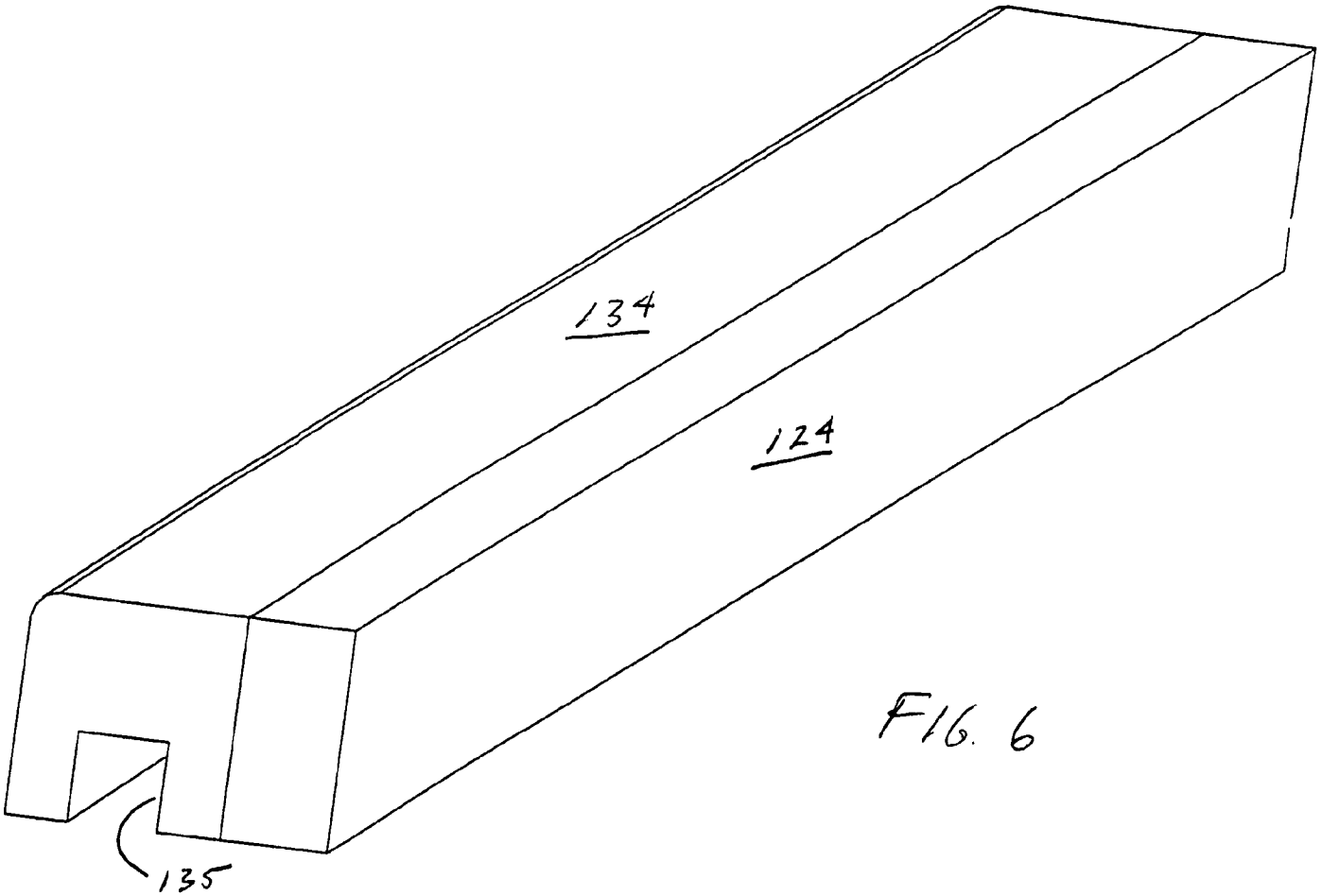
FIG. 6 presents an enlarged perspective view of a cleaning pad, according to an aspect of the invention.

Referring now to FIG. 6, an enlarged perspective view of the slotted bar 134 and pad 124 is presented. The slotted bar 134 comprises a slot 135 similar to a keyway.

In a certain embodiment, the cleaning pad 124 is a replaceable polyaramide needled felt pad, 0.125 inch thk.×0.25 inch wide×14.75 inch long, bonded to the slotted bar 134, which is metal. A suitable fiber is Nomex® (E. I. Dupont and de Nemours, & Co.) polyarimide fiber. A suitable polyaramide fiber pad material is available from BMP America, Inc., of Medina, N.Y., as catalogue number CX-18.5-FPES2. The pad, after bonding to the slotted bar 134, is precompressed at 300° F. for 1 minute with a 25 pound load, and the exposed surface is singed to remove loose fiber ends. The slotted bar 134 is slid lengthwise into the pad holder 128.

The Solenoid exerts a minimum force of 6 lbs. This force is magnified by 3.5 times through the principal of mechanical leverage, thereby providing a minimum of 21 lbs. distributed across a 14.5 inch long cleaning pad 124. To enable immediate cleaning the pad is engaged for 15 seconds immediately after completion of a job. This is sufficient for cleaning during short standby periods, even though pressure roller 104 is not at an optimum temperature for cleaning because the temperature of the pressure roller tends to decrease while the paper stream is passing between the pressure roller 104 and the fuser roller 108 (note that the pressure roller 104 is heated secondarily by the fuser roller 108 and the paper stream acts like an insulator between the two). The cleaning pad 124 is then disengaged for 245 seconds, which gives the fuser roll 108 time to heat the pressure roller 104 time to heat back to approximately 290° F. The higher temperature has been shown to clean easier than a cooler pressure roller. The temperature of the pressure roller 104 can drop as much as 90° F. during a paper run. After 245 seconds a second 15 second cleaning cycle is initiated wherein the cleaning pad 124 is pressed against the pressure roller 104. In order to reduce unnecessary, frequent, immediate cleaning cycles, a 1000 sheet minimum run requirement may be implemented before these actuations occur. We also abandon any cleaning cycle, if a new job gets started before the cleaning cycle is done, so as not to impact productivity. Periodically replacing the cleaning pad 124 is desirable.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. An apparatus for cleaning a pressure roller that cooperates with a fuser roller in fusing toner images, comprising a cleaning pad mounted adjacent said pressure roller in an electrographic printer in a position to clean said pressure roller only during standby, wherein said cleaning pad is mounted on a support, and further comprising a gimbal pivot that allows said cleaning pad to align longitudinally with said pressure roller.

2. The apparatus of claim 1, wherein said cleaning pad is replaceable.

3. The apparatus of claim 1, wherein said cleaning pad is bonded to a support bar.

4. An apparatus for cleaning a pressure roller that cooperates with a fuser roller in fusing toner images, comprising a cleaning pad mounted adjacent said pressure roller in an electrographic printer in a position to clean said pressure roller only during standby, wherein said cleaning pad is mounted on a paper entrance guide that guides sheets into a nip formed between said pressure roller and said fuser roller.

5. The apparatus of claim 4, wherein said cleaning pad is replaceable.

6. The apparatus of claim 4, wherein said cleaning pad is bonded to a support bar.

* * * * *